US005230355A

United States Patent [19]

Weingrod

[11] Patent Number: 5,230,355

[45] Date of Patent: Jul. 27, 1993

[54] HAIRBAND

[75] Inventor: Merrill Weingrod, South Dartmouth, Mass.

[73] Assignee: The Leather Shop, W. Concord, Mass.

[21] Appl. No.: 819,229

[22] Filed: Jan. 10, 1992

[51] Int. Cl.[5] ..... A45D 8/12

[52] U.S. Cl. ..... 132/275; 132/273; 2/181

[58] Field of Search ..... 132/273, 275; 2/181

[56] References Cited

U.S. PATENT DOCUMENTS

| | | | |
|---|---|---|---|
| D. 105,989 | 9/1937 | Girouard | 132/273 |
| D. 131,600 | 3/1942 | Holden | 132/273 |
| 1,146,934 | 7/1915 | Gleeson | 132/273 |
| 1,262,093 | 4/1918 | Preston | 132/275 |
| 1,287,626 | 12/1918 | Brett | 132/273 |
| 1,392,684 | 10/1921 | Hamilton | 132/275 |
| 2,488,954 | 11/1949 | Winters | 132/275 |

*Primary Examiner*—Gene Mancene
*Assistant Examiner*—Frank A. LaViola
*Attorney, Agent, or Firm*—Wolf, Greenfield & Sacks

[57] ABSTRACT

A hairband construction, preferably for use in a pony-tail hair style, is provided which is formed from an elongated material section and an elongated elastic section having a cross-section generally smaller than that of the material section. A pair of connectors are adapted to secure ends of the plastic section to regions adjacent to the ends of the material section. The connectors are flat plates, which may be secured to the material section with an adhesive. The connectors also have holes for the receipt of an end of the elastic section.

18 Claims, 3 Drawing Sheets

HAIRBAND

BACKGROUND OF THE INVENTION

1. Field of the Invention

The present invention relates to hairbands adapted to be worn in hair, primarily in a pony tail hair style for decorative purposes, and to methods for the construction of such hairbands.

2. Description of the Prior Art

Conventional methods for holding the hair in place involve the use of barrettes, clips, combs, or elastic bands. Typically, when the hair is in a pony tail, the wearer will use an elastic band alone, or in combination with an ornament for a more aesthetic presentation, to clasp the hair in the back or on the side of the head.

While many hairbands or fasteners have been available in the prior art which can be worn primarily for aesthetic purposes, there is always a demand for a band which provides a new and more aesthetically pleasing effect. In addition users also want such hairbands to be well constructed so that the band maintains its shape and appearance and does not come apart in use over an extended period of time. The typical methods for holding the hair in place, particularly in a pony tail hair style, frequently fail to address these features as well as user comfort. For example, ornaments which are added to elastic bands may be separated from or fail to conceal the band, thereby limiting the aesthetic effect. Other methods of holding the hair in place utilizing barrettes, clips, or combs may adversely effect wearer comfort by pulling the hair, rubbing against the wearer's neck, failing to remain in place, or falling out of the hair altogether.

SUMMARY OF THE INVENTION

According to the present invention a hairband construction which is formed from an elongated material section having first and second ends and a first cross-section and an elongated elastic section having first and second ends and a second cross-section which is smaller than the first cross section of the material section. First and second connectors, adapted to secure the corresponding ends of the elastic section to regions adjacent to the ends of the material section, are provided.

It is an object of the invention to provide a new and improved hairband construction which provides for an aesthetically pleasing appearance, is comfortable to wear and is sturdy so as to maintain its shape and appearance over an extended period of time. Another object of the invention is to provide a hairband construction which is relatively simple and inexpensive to fabricate.

Other objects and features of the present invention will become apparent from the following detailed description when taken in connection with the accompanying drawings which disclose a preferred embodiment of the invention. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1:
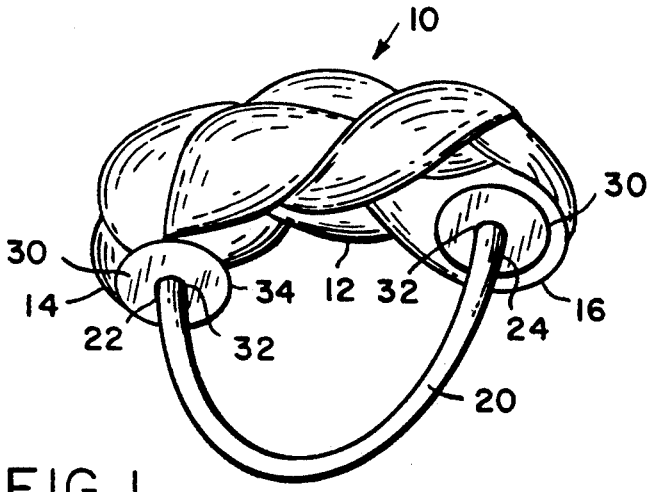
FIG. 1 is a front bottom perspective view of one embodiment of the hairband construction of the present invention.

Turning now to the Figures, FIG. 1 illustrates one embodiment of the present invention wherein hairband 10 comprises an elongated material section 12 having a first end 14 and a second end 16.

The materials used in the material section 12 may vary in color, design, texture and other factors to achieve the desired aesthetic effects. In some embodiments the material section 12 may be formed of a plurality of elongated strands of material which are interconnected in a predetermined way, such as braided or countertwisted together. Additionally, the material section 12 may be formed of strands of material which may or may not be the same material, or have the same cross section. Decorative elements, such as beads, bows, buttons or the like, may also be included on the material section 12. Preferably, the material section 12 is formed of at least one tubular fabric element (i.e., a fabric tube containing a stuffing). Most preferably, the material section is formed of a single piece of a knotted or braided tubular fabric. The material section is typically about 2½ to 4½ inches long and preferably is non-elastic. Preferably, the material section 12 is about 3 to 4 inches long, such length found to be both comfortable and appealing to the wearer.

The hairband 10 also comprises a elongated elastic section 20 having a first end 22 and a second end 24. The elastic section 20 typically has a circular cross-section, which is preferably smaller than the cross section of the material section 12.

Figure 4A:
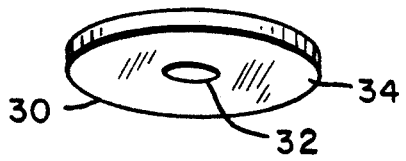
FIGS. 4A–4E are perspective views of various embodiments of a connectors utilized in the present invention to secure one end of the elastic section to a region adjacent to an end of the material section.
Figure 4B:
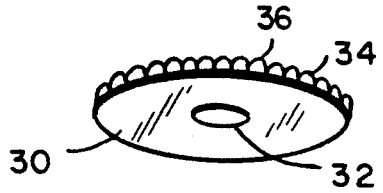
Figure 4C:
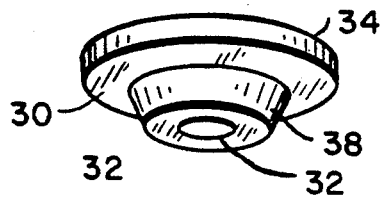

The elastic section 20 may be formed of a piece of standard tubular elastic material. Typically, the elastic has a cross-sectional diameter of about ⅛th to about ¼th inch; and a length of between about 3 to 5 inches, such length having been found to accommodate most hair styles and thicknesses. The elastic section 20 preferably includes a nylon, or similar fabric cover, which protects, and minimizes any tendency of, the elastic to pull apart or unravel once subjected to stress. The elastic material 20 may be any desired color or design and would typically complement the color or design of material section 12. The hairband 10 also comprises connectors 30 adapted to secure the corresponding ends 22, 24 of the elastic section 20 to regions adjacent to the ends 14, 16 of the material section 12. The connectors 30 are typically arranged on the same side of the material section 12. Preferably, the connectors 30 are arranged in a substantially coplanar relationship. As one example, the connectors may comprise substantially flat plates, and may be constructed of a metal, plastic, or other material which may be secured to the material section 12. Preferably, the connectors 30 each have an outer rim 34, as shown in FIGS. 4A–4C, extending substantially perpendicularly toward the material section to provide additional support. An adhesive (not shown) is preferably applied to the connectors, on the portion of the connectors facing the material section. The adhesive used may be any commercially available product which will secure the material section 12 to one side of the connector. Although an adhesive is preferred, other conventional securing methods known to those skilled in the art may be used.

As shown in FIGS. 5A–E, the elastic section of the hairband is typically secured to a first connector 30A through hole 32A, and to a second connector 30B through hole 32B which is provided to receive the ends of the elastic. The diameter of the holes in the connectors can typically accommodate the cross-sectional diameter of the elastic section. Preferably, the hole is recessed to accommodate the end of the elastic section, thereby providing a greater surface area to contact the material section.

Figure 2:
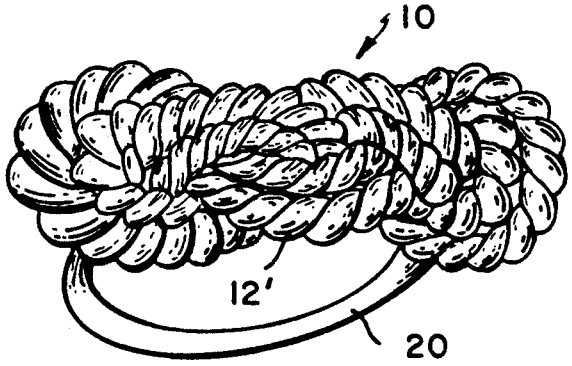
FIG. 2 is a front top perspective view of a different embodiment of the present invention.

Another embodiment of the hairband 10 of the present invention is illustrated in FIG. 2. In this embodiment, the material section 12' is formed of a plurality of strands. Elastic section 20 is secured to this and all other embodiments of the invention as described above.

Figure 3:
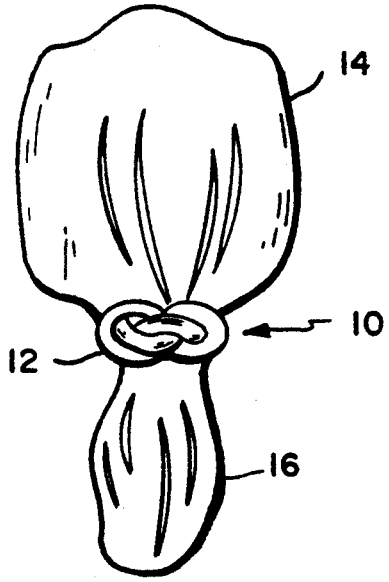
FIG. 3 is a perspective view of a person wearing the hairband of the type shown in FIG. 1.

Referring to FIG. 3, the manner in which hairbands 10 in accordance with the present invention may be worn is shown. The wearer's hair 14 is clasped in the back of the head into a pony tail 16. Preferably, the material section 12 of the hairband 10 will remain visable to provide a more aesthetic appearance, while the elastic section is normally covered.

Next, referring to FIGS. 4A–E, various embodiments of the connector 30, as described above, are illustrated. FIG. 4A shows the flat plate connector 30 with a hole 32 for receiving an end of the elastic material, having outer rim 34 which extends toward the material section.

FIG. 4B shows the connector of FIG. 4A with outer rim 34 having tooth-like projections 36 which may be bent to engage the material to provide additional support for the connection between the material section and the connector.

FIG. 4C shows the preferred embodiment of the connector which includes a recess 38 whereby the end of the elastic material may be placed, once it is fitted through the connector, allowing for more surface area of the connector to come into contact with the material section.

Figure 4D:
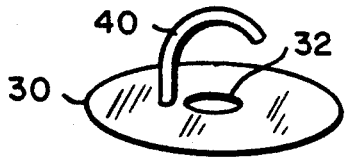

FIG. 4D shows the flat plate connector having a staple or hook 40, which is integral to the connector, for securing the end of the elastic section received through the hole.

Figure 4E:
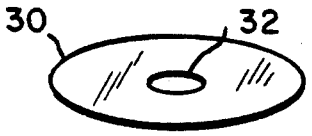

FIG. 4E shows a simple embodiment of the connector having only a flat plate and a hole.

Several methods may be utilized to secure the elastic section to the connectors. Various examples are illustrated in FIGS. 5A–E.

Figure 5A:
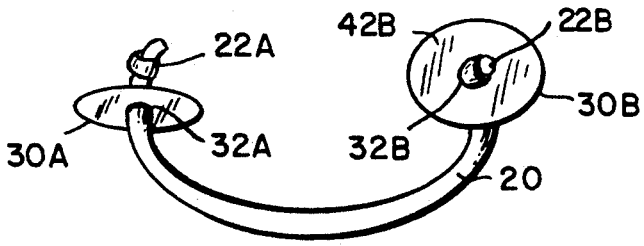
FIGS. 5A–5E are perspective views illustrating various methods of securing the elastic section to the connector.
Figure 5B:
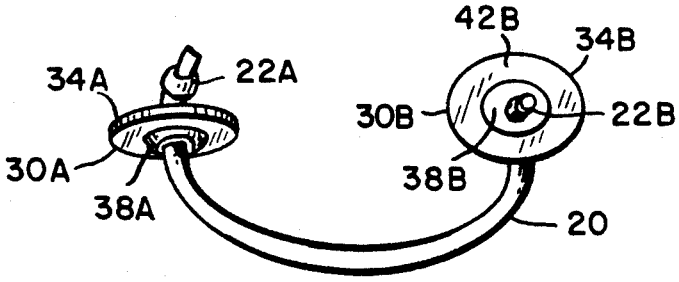

FIGS. 5A and 5B show one preferred method of securing the elastic section 20, whereby the first and second end of the elastic section are tied into knots 22A, 22B after being passed through the holes 32A, 32B, in the first and second connectors 30A, 30B. An adhesive (not shown) may be applied on the side 42A, 42B of each connector facing the material section. FIG. 5B illustrates the recess 38A, 38B, which may accommodate knots 22A, 22B, and the outer rim 34A, 34B along the edge of the connector to provide additional support for the connection of the material section.

Figure 5C:
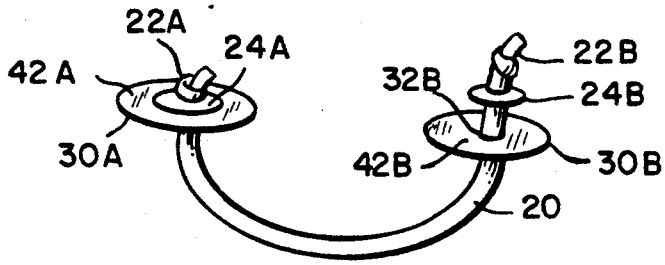
Figure 5D:
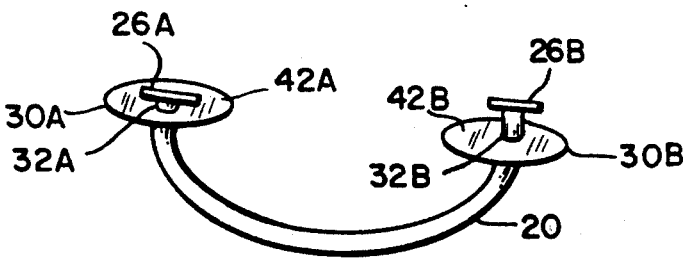
Figure 5E:
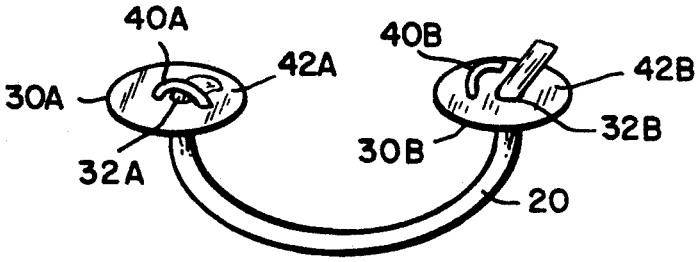

FIGS. 5C, 5D and 5E show alternative methods of securing the elastic material to the connector. The elastic may be secured by applying O-rings 24A, 22B near the ends of the elastic material once the end is fitted through the hole. Alternatively, T pins 26A, 26B may be used to prevent the elastic material from withdrawing from the hole of the connectors. Additionally, a hook or staple 40A, 40B, integral with the connector, may be used to secure the elastic section as shown. It should be noted that other methods known in the art may be utilized to secure the elastic material.

The hairband of the present invention is constructed by fitting the first end 22 of the elongated elastic section 20 through a hole 32 in a connector 30. Once through the hole, the elastic is knotted near the first end such that the knot 22A has a wider cross-sectional diameter than the hole. Other methods of securing the elastic section may be utilized (FIG. 5 illustrates several examples, discussed above). The connector may have a recess 38 surrounding the hole where the knot (or other securing means) may be placed. An adhesive (not shown) may then be applied to the side 42 of the connector facing the region adjacent to the first end 14 of the material section 12. Other methods to secure the connector to the material section may also be used, as may be apparent to those skilled in the art.

While the invention has been shown and described above with respect to a number of embodiments, it is apparent that the material section may have other configurations than the two shown while still remaining within the invention. The foregoing detailed description has been given for clearness of understanding only, and unnecessary limitations are not to be construed therefrom. The invention is not to be limited to the exact details shown and described since obvious modifications will occur to those skilled in the art, and any departure from the description herein that conforms to the present invention is intended to be included within the scope of the claims.

What is claimed is:

1. A hairband comprising:

an elongated material section having first and second ends and a first cross-section;

an elongated elastic section having first and second ends and a second cross-section which is smaller than the first cross-section of the material section;

a first connector adapted to secure the first end of said elastic section to a region adjacent to the first end of said material section; and a second connector adapted to secure the second end of said elastic section to a region adjacent to the second end of said material section;

wherein said first and second connectors are substantially flat plates having an outer rim extending toward said material section and a hole through which said elastic section is received and secured, and wherein said outer rim has tooth-like projections.

2. The hairband as claimed in claim 1 wherein said material section is formed of a plurality of elongated strands of material which are interconnected in a predetermined way.

3. The hairband as claimed in claim 2 wherein said strands are braided together.

4. The hairband as claimed in claim 2 wherein said strands ar countertwisted together.

5. The hairband as claimed in claim 2 wherein said strands are all of the same material.

6. The hairband as claimed in claim 2 wherein at least two of said strands are of different material.

7. The hairband as claimed in claim 2 wherein all of said strands have the same cross-sections.

8. The hairband as claimed in claim 2 wherein at least two of said strands have different cross-sections.

9. The hairband as claimed in claim 2 wherein at least one of said strands is of a tubular fabric.

10. The hairband as claimed in claim 1 wherein said material section is formed of a single piece of material.

11. The hairband as claimed in claim 10 including at least one decorative element on said piece of material.

12. The hairband as claimed in claim 1 including at least one decorative element on said material section.

13. The hairband as claimed in claim 1 wherein said elastic section has a generally circular cross-section.

14. A method of fabricating a hairband comprising the steps of:

(a) providing an elongated elastic section, having first and second ends, an elongated material section having first and second ends, and first and second connectors for attaching the first and second ends of the elongated elastic section to the first and second ends of the elongated material section respectively;

(b) fitting the first end of the elongated elastic section, through a hole in the first connector;

(c) knotting the first end of the elastic section;

(d) applying an adhesive to the side of said first connector facing a region adjacent to the first end of said material section; and (e) securing the first connector to said region adjacent to the first end of said material section.

15. The method of claim 14 further comprising the step of:

(f) repeating steps (b) through (e) for said second end of the elongated elastic section, said second connector, and said second end of said material section.

16. A hairband comprising:

an elongated material section having first and second ends and a first cross-section;

an elongated elastic section having first and second ends and a second cross-section which is smaller than the first cross-section of the material section;

a first connector adapted to secure the first end of said elastic section to a region adjacent to the first end of said material section; and a second connector adapted to secure the second end of said elastic section to a region adjacent to the second end of said material section;

wherein said first and second connectors are substantially flat plates having a hole through which said elastic section is received and secured, and wherein said plates have an outer rim extending toward said material section.

17. The hairband as claimed in claim 16 wherein said hole in said first and second connectors is recessed.

18. The hairband as claimed in claim 17 wherein said first and second connectors are attached to said first and second ends of said material section with an adhesive.

* * * * *